US011058170B2

(12) United States Patent
Nishiwaki et al.

(10) Patent No.: US 11,058,170 B2
(45) Date of Patent: Jul. 13, 2021

(54) FOOTWEAR

(71) Applicant: ASICS Corporation, Kobe (JP)

(72) Inventors: Tsuyoshi Nishiwaki, Kobe (JP); Sho Takamasu, Kobe (JP); Koki Matsuo, Kobe (JP); Yutaro Iwasa, Kobe (JP); Shigeyuki Mitsui, Kobe (JP); Katsunori Yagyu, Kobe (JP)

(73) Assignee: ASICS CORPORATION

( * ) Notice: Subject to any disclaimer, the term of this patent is extended or adjusted under 35 U.S.C. 154(b) by 128 days.

(21) Appl. No.: 16/066,643

(22) PCT Filed: Dec. 28, 2015

(86) PCT No.: PCT/JP2015/086472

§ 371 (c)(1),
(2) Date: Jun. 27, 2018

(87) PCT Pub. No.: WO2017/115402

PCT Pub. Date: Jul. 6, 2017

(65) Prior Publication Data

US 2018/0368514 A1 Dec. 27, 2018

(51) Int. Cl.
*A43B 7/32* (2006.01)
*A43B 13/14* (2006.01)
(Continued)

(52) U.S. Cl.
CPC ..... *A43B 7/32* (2013.01); *A43B 13/14* (2013.01); *A43B 13/181* (2013.01);
(Continued)

(58) Field of Classification Search
CPC ..... A43B 3/0026; A43B 5/007; A43B 5/145; A43B 7/32; A43B 13/125; A43B 13/183
See application file for complete search history.

(56) References Cited

U.S. PATENT DOCUMENTS 5,528,842 A 6/1996 Ricci et al.
7,234,250 B2 * 6/2007 Fogarty ..... A43B 13/223 36/61
(Continued)

FOREIGN PATENT DOCUMENTS

JP 01-303334 A 12/1989
JP 2905928 B 7/1991
(Continued)

OTHER PUBLICATIONS

Extended European Search Report for European Patent Application No. 15912068.2 dated Jul. 25, 2019.
(Continued)

*Primary Examiner* — Sharon M Prange
(74) *Attorney, Agent, or Firm* — Katten Muchin Rosenman LLP

(57) ABSTRACT

There is provided a footwear capable of efficiently removing vibrations of specific frequencies that could propagate to the human body upon landing during running or walking. A footwear includes a sole; an upper connected to an upper-side perimeter region of the sole; and a vibration absorbing unit which absorbs vibration generated by an impact upon landing. The vibration absorbing unit includes a platy flexible support portion which has a smaller rigidity in the vertical direction than in the horizontal direction, and a weight portion provided in the support portion. The support portion is fixed to the sole or the upper, surrounding a perimeter of the weight portion.

18 Claims, 13 Drawing Sheets

(51) Int. Cl.

| | |
|---|---|
| ***A43B 13/18*** | (2006.01) |
| *A43B 5/06* | (2006.01) |
| *A43B 17/00* | (2006.01) |
| *A43B 17/14* | (2006.01) |

(52) U.S. Cl.
CPC ..... *A43B 13/187* (2013.01); *A43B 5/06* (2013.01); *A43B 17/003* (2013.01); *A43B 17/14* (2013.01)

(56) References Cited

U.S. PATENT DOCUMENTS

| | | | | |
|---|---|---|---|---|
| 8,056,261 | B2 * | 11/2011 | Nakano | A43B 7/14 36/27 |
| 8,474,156 | B2 * | 7/2013 | Kim | A43B 1/0054 335/207 |
| 9,210,967 | B2 * | 12/2015 | Gerber | A43B 5/02 |
| 2005/0011607 | A1 | 1/2005 | Hensley et al. | |
| 2006/0157901 | A1 * | 7/2006 | Vito | A61F 13/069 267/136 |
| 2008/0066348 | A1 * | 3/2008 | O'Brien | A43C 15/168 36/100 |
| 2010/0139124 | A1 | 6/2010 | Kim | |
| 2011/0067271 | A1 * | 3/2011 | Foxen | A43B 13/16 36/131 |
| 2011/0265351 | A1 | 11/2011 | Mori et al. | |
| 2012/0169442 | A1 | 7/2012 | Kim | |
| 2012/0324761 | A1 * | 12/2012 | Sills | A43B 13/146 36/103 |

FOREIGN PATENT DOCUMENTS

| | | | |
|---|---|---|---|
| JP | 07-023804 | A | 1/1995 |
| JP | 07-313203 | A | 12/1995 |
| JP | 09-273582 | A | 10/1997 |
| JP | 11-506027 | A | 6/1999 |
| JP | 2007-530308 | A | 11/2007 |
| JP | 2010-525918 | A | 7/2010 |
| JP | 5459741 | B2 | 1/2014 |
| WO | 2015/017920 | A1 | 2/2015 |

OTHER PUBLICATIONS

The Japan Society of Mechanical Engineers Symposium: Sports and Human Dynamics Technical Papers; 2011 Technical Papers, "B7 Indoor Shoes Design that Takes into Account the Jump Landing Shock".

International Search Report for International Application No. PCT/JP2015/086472.

* cited by examiner

FOOTWEAR

TECHNICAL FIELD

The present invention relates to footwear which is capable of reducing vibration caused by landing impact and decreasing influence on a human body.

Background Art

Jogging, marathon and other running activities are common exercises today, and it is not uncommon for people to make running exercises on a paved road. It is already known that repeated impact received when landing on a paved road has harmful influences on the human body.

Landing impact generates vibrations, from which vibrations of specific frequencies are propagated to the human body. These frequencies fall primarily in a range up to 200 Hz. This frequency band covers resonant frequencies of many body parts (e.g., 50-100 Hz for the chest), and research activities reveal that these frequencies cause discomfort (Non-Patent Literature 1).

A conventional common approach to this problem is to decrease rigidity of a shoe sole. Specifically, an easily deforming shoe sole shape is selected, or soft material such as a gel or a foam material is utilized to decrease shoe sole rigidity and increase cushioning performance.

However, use of cushioning material in the shoe sole has a problem that there is a limitation in the thickness of shoe sole and therefore the sole's cushioning performance is unavoidably limited. Developing a material which has a superior cushioning capability poses a challenge that the material must also have sufficient durability to endure repeated impact, and this has been a technical difficulty. Still another problem with cushioning material is while it is possible to decrease vibrations of a frequency band near and lower than 10 Hz, the material is not as effective to vibrations of higher frequencies.

Other than decreasing shoe sole rigidity, there have been other approaches for improved cushioning performance, as exemplified by Patent Literature 1 (Japanese Patent No. 2905928 Gazette). Patent Literature 1 discloses a footwear, which makes use of a vibration absorbing unit including a vibration absorbing body and a mass body which is supported by the vibration absorbing body via a bearing body. The unit is disposed in a midsole of a shoe whereby vibration energy generated in the footwear is converted into vibration of the vibration absorbing body and absorbed.

Also, Patent Literature 2 (Japanese Patent No. 5459741 Gazette) discloses a technique of providing a vibration space in a shoe sole, and disposing a vibration device in the vibration space.

CITATION LIST

Patent Literature

Patent Literature 1: Japanese Patent No. 2905928 Gazette
Patent Literature 2: Japanese Patent No. 5459741 Gazette

Non-Patent Literature

Non-patent Literature 1: The Japan Society of Mechanical Engineers Symposium: Sports and Human Dynamics Technical Papers; 2011 Technical Papers, "B7 Indoor Shoes Design that Takes into Account the Jump Landing Shock"

SUMMARY OF INVENTION

Technical Problem

However, the vibration absorbing unit in Patent Literature 1 does not take into account vibration directions of the mass body. As far as one understands from the configuration in FIG. 2, it is believed that the mass body will vibrate significantly in a plurality of directions such as fore and aft, up and down, obliquely up and down, etc. Therefore, it is difficult to effectively reduce vibrations, particularly vibrations in the vertical direction, propagated to the human body at the time of running or walking.

Also, the technique disclosed in Patent Literature 2 is about disposing a cantilever vibration plate in the vibration space, with the open end of the cantilever mounted with a magnet to vibrate the vibration plate for purposes of increased interest in walking and improved blood flow. In other words, no consideration is made for reduction of vibration generation in the human body at the time of running or walking, and as a matter of course, there is no arrangement disclosed for reducing these vibrations. Also, since the vibration plate is vibrated by an external force caused by magnetic repulsion, the vibration does not cease and leaves uncomfortable vibration components after landing.

Therefore, an object of the present invention is to solve the above-described problems, and to provide a footwear which is capable of efficiently removing vibrations of specific frequencies that could propagate to the human body upon landing during running or walking.

Solution to Problem

In order to achieve the above-described object, the following footwear is provided.

A footwear according to an embodiment of the present invention includes a sole; an upper connected to an upper-side perimeter region of the sole; and a vibration absorbing unit which absorbs vibration generated by an impact upon landing.

The vibration absorbing unit includes a platy flexible support portion which has a smaller rigidity in the vertical direction than in a horizontal direction, and a weight portion placed in the support portion. The support portion surrounds a perimeter of the weight portion, and is fixed to the sole or the upper.

In the arrangement described above, the vibration absorbing unit may be disposed inside a housing space provided in a heel portion of the sole. This makes it possible to absorb the vibration efficiently at the heel portion where a large impact is received at the time of landing.

In the arrangement described above, the support portion may have its entire outer perimeter fixed or intermittently fixed.

Also, the housing space may be opened in a lower surface of the sole. This makes it easy to check operation of the vibration absorbing unit. It is preferable in this arrangement, that in order to prevent the vibration absorbing unit from damage by contact with external foreign object or the like, the opening of the housing space should be closed with a protection plate. It is also preferable that the protection plate is made of a transparent or translucent material for easy visual observation into the housing space.

When disposing the support portion inside the housing space, the support portion may be supported by a side wall of the housing space along its entire perimeter. Disposing in such a way makes it easy to make adjustment on a vibration amplitude of the weight portion.

Also, the vibration absorbing unit may have a plurality of the weight portions which are different in their weight. This makes it more likely to generate vibrations of a plurality of frequency bands, making it possible to reduce vibrations of the corresponding frequency bands caused by the impact.

Also, the support portion may have its center region provided by a low rigidity region which has a lower rigidity than surrounds, and the plurality of the weight portions are attached on two sides of the support portion, with the low rigidity region in between. This makes it possible to generate a vibration including frequencies of a plurality of bands. It should be noted here that the low rigidity region may be provided by a thin portion provided in the support portion. Specifically a groove, a fold or the like may be used as the thin portion.

The vibration absorbing unit may have its support portion and weight portion made integrally with each other using the same material. By making the weight portion thicker than the support portion, the support portion and the weight portion can be made integrally with each other. This makes it possible to increase production efficiency.

The sole may include an upper sole and a lower sole disposed under the upper sole. With this, the support portion may be supported by being caught between the upper sole and the lower sole. By disposing the support portion as described, it becomes possible to dispose the vibration absorbing unit easily and reliably inside the housing space.

There may be an arrangement that the sole includes an upper sole and a lower sole, and the support portion is made integral with the upper sole or the lower sole. This allows integral formation of the support portion and the sole, thereby increasing production efficiency.

There may be an arrangement that the sole includes a shank disposed at a region of the arch of a foot; and the support portion is provided by a tongue piece extending from the shank toward the heel region.

Also, there may be an arrangement that the sole is made wider in its midfoot region than its heel region; and the vibration absorbing unit is disposed inside the housing space in a midfoot region of the sole. This allows to make a large housing space, which makes it possible to increase the volume of weight portion. The arrangement makes it possible to make the weight portion vibrate at a lower frequency, and thereby to absorb a shock from the low-frequency components.

In the arrangement described above, it is possible to dispose the weight portion at an arch-shaped area of the arch. Namely, the midfoot region which does not play a large part in providing cushion can be used to dispose the vibration space. This makes it possible to reduce decrease in overall cushion capabilities of the sole. This also makes it possible to reduce sinking of the arch-shaped area of the arch, using the weight portion.

There may be still another arrangement that the upper or the sole has an attaching base protruding outward with respect to the upper or the sole and having a holding hole for housing the vibration absorbing unit; with the vibration absorbing unit having its support portion joined and fixed to a circumferential edge of the holding hole. Also, the attaching base may protrude rearward from a heel region of the upper, or protrude in left and right directions from a border region between the upper and the sole.

It is preferable that the support portion has a rigidity in the vertical direction in a range from 0.1 through 2000 N/m, and the weight portion has a mass in a range 0.001 through 0.030 kg.

Also, it is preferable that the ratio between the rigidity in the vertical direction and the rigidity in the horizontal direction of the support portion is not smaller than 8.

A footwear according to another embodiment of the present invention includes a sole; an upper connected to an upper-side perimeter region of the sole; and a vibration absorbing unit which is housed inside a housing space provided in the sole and absorbs vibration generated by an impact upon landing;

the vibration absorbing unit includes a platy support portion which is deflected by a landing impact; and a weight portion which is provided in the support portion; and a space above and below the vibration absorbing unit is not smaller than three times of an amount of deflection of the vibration absorbing unit in the vertical direction caused by a weight of the vibration absorbing unit itself.

Also, a footwear according to an embodiment of the present invention includes a sole; an upper connected to an upper-side perimeter region of the sole; and a vibration absorbing unit which absorbs vibration generated by an impact upon landing;

the vibration absorbing unit includes a platy support portion which is deflected by a landing impact; and a weight portion which is provided in the support portion; and the support portion has a smaller rigidity in the vertical direction than in a horizontal direction, and is made of a material which has a loss tangent not smaller than 0.01 under a condition of 25 degrees Celsius and 50 Hz.

Advantageous Effects of Invention

According to the footwear having the arrangement described above, the rigidity of the support portion in the vertical direction is smaller than the rigidity in the horizontal direction, and therefore the weight portion vibrates mainly in the vertical direction at the time of landing in walking or running. This efficiently absorbs energy generated by landing impact of the foot during running or walking activities, and thus it is possible to remove vibrations which would otherwise propagate to the body.

The support portion surrounds a perimeter of the weight portion, and is fixed to the sole or the upper. This makes it easy to control vibration amplitude of the support portion for example, and efficiently remove vibrations of specific frequencies.

BRIEF DESCRIPTION OF DRAWINGS

FIG. 14(*A*) is a perspective view with a partial section, whereas FIG. 14(*B*) is a side view.

DESCRIPTION OF EMBODIMENTS

First Embodiment

Figure 1:
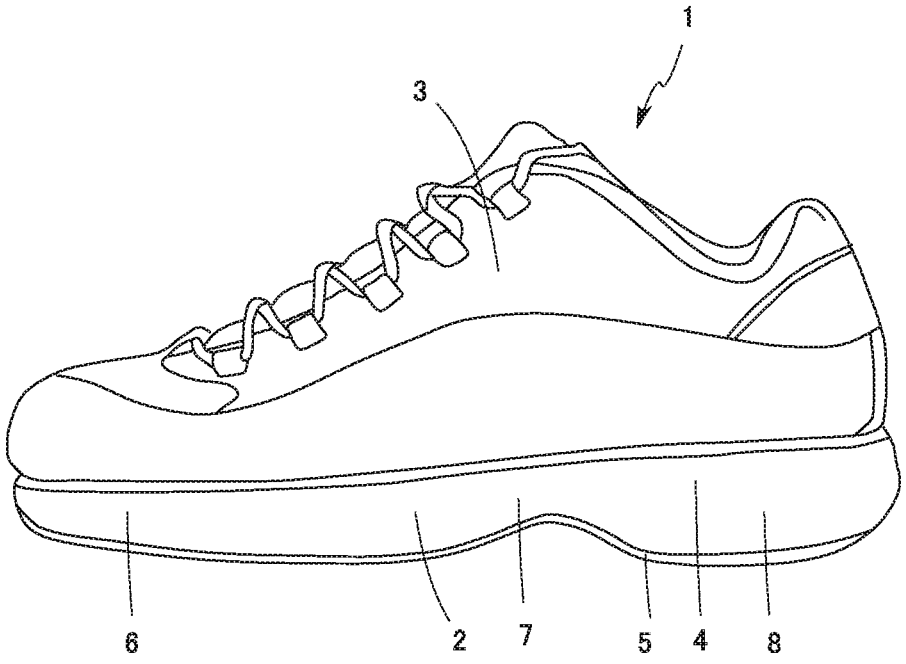
FIG. 1 is a schematic drawing which shows an external structure of a sports shoe as an embodiment of the footwear of the present invention.
Figure 2:
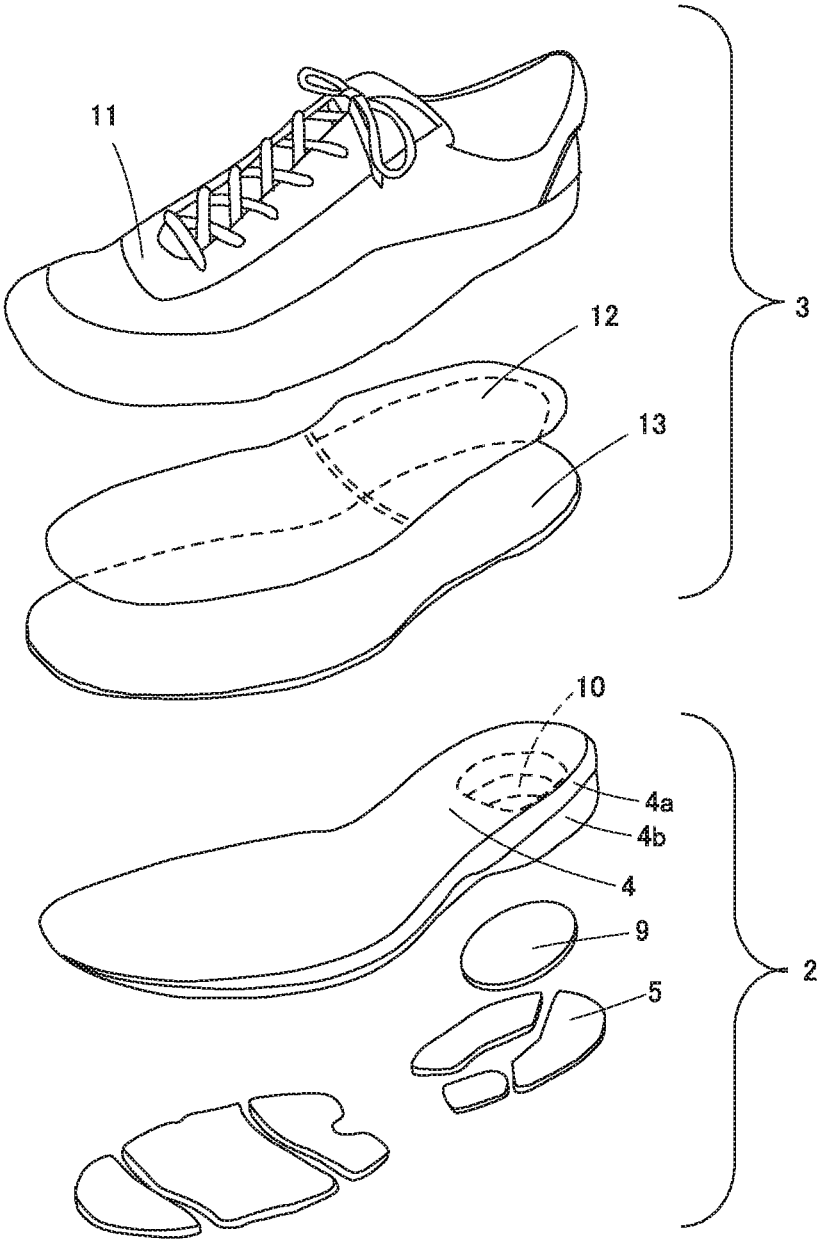
FIG. 2 is an exploded perspective view of the sports shoe in FIG. 1.

FIG. 1 shows an external structure of a sports shoe as a first embodiment of the footwear according to the present invention, whereas FIG. 2 is an exploded perspective view of the sports shoe in FIG. 1. A sports shoe 1 according to the present embodiment includes a sole (shoe sole) 2 and an upper (top part) 3 which is connected onto an upper side of the sole 2. While the sports shoe 1 is provided in a mutually symmetrical pair of a left and a right shoes (one shoe for the right foot and the other for the left), FIG. 1 and FIG. 2 show only one for the left foot.

In the present embodiment, the sole 2 has a multi-layer structure as shown in FIG. 2, including a midsole 4 and an outer sole 5. The sole 2 may be provided by a foamed or non-foamed body which is made of rubber, resin and so on as a suitable material.

The midsole 4 has a laminated structure of an upper midsole 4*a* and a lower midsole 4*b*. The laminated structure is utilized entirely in the present embodiment for a purpose of forming a housing space 10 which will be described later. However, the laminated structure may only be made for a heel region.

The sole 2 is functionally divided into a forefoot region 6, a midfoot region 7 and a heel region 8 in the order from the front. In a normal design, the forefoot region 6 and the heel region 8 make contact with the ground while the midfoot region 7 does not. However, in the present embodiment, all of the forefoot region 6, the midfoot region 7 and the heel region 8 may make contact with the ground, i.e., the embodiment includes flat-sole designs. In the sole 2, it is not necessary that the forefoot region 6, the midfoot region 7 and the heel region 8 have clearly defined borders in their shape. For a flat sole, a region generally corresponds to the arch of the foot is defined as the midfoot region 7.

There is no specific limitation to the thickness of sole 2. The thickness may be selected appropriately to an expected application. As an example, the forefoot region 6 and the midfoot region 7 may have a thickness not smaller than 5 mm and not greater than 20 mm, whereas the heel region 8 may have a thickness not smaller than 5 mm and not greater than 40 mm. In other words, the thickness of the heel region 8 may be equal to that of the forefoot region 6 and of the midfoot region 7, or greater than that of the forefoot region and of the midfoot region 7. Also, the thickness of the forefoot region and the thickness of the midfoot region 7 may be different from each other.

The midsole's heel region 8 is formed with a housing space 10 which has an opening on the lower side. The opening of the housing space 10 is closed with a protection plate 9. The protection plate 9 has its perimeter region sandwiched between the midsole 4 and the outer sole 5, and is fixed therebetween. The outer sole 5 is formed into a shape of U so that an area occupied by the protection plate 9 does not interfere with the protection plate 9. In the present embodiment, the protection plate 9 is translucent. The translucent protection plate 9 allows visual inspection, e.g., to check if the vibration absorbing unit 14 is broken or not. It should be noted here that the term translucent refers to a degree of transparency which enables visual inspection to be made for inside the housing space 10; specifically, a visual light transmissivity not lower than 30%, for example.

The upper 3 includes a top cover 11 which is connected to near a peripheral region of an upper portion of the sole 2 and covers the foot of the wearer; an inner sole 12 which is disposed on an inside bottom surface of the top cover 11; and an insole 13 which prevents injury upon treading on a sharp object. The insole 13 may be provided by a plate of metal, synthetic resin, woven fabric of a high-strength fiber, etc. Although it is attached onto the upper, it may instead be laminated onto the sole's upper surface, as part of the sole.

The sole 2 and the upper 3 are connected by means of any method such as sewing and bonding.

The top cover 11 may be made of such a material as natural leather, synthetic leather and woven cloth, but a material not easily penetrated by nails, for example, are preferred.

Figure 3:
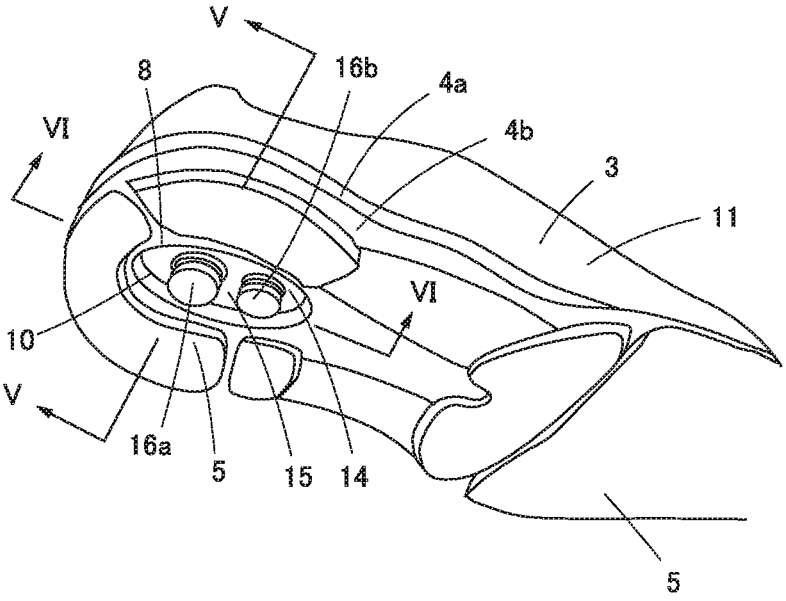
FIG. 3 is a schematic drawing which shows an arrangement of the sports shoe in FIG. 1 viewed from a shoe sole side.
Figure 4:
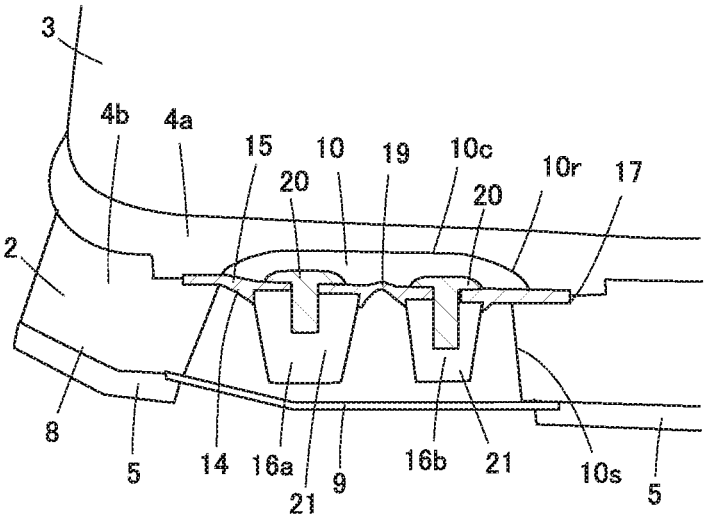
FIG. 4 is a sectional view taken in line VI-VI in FIG. 3.
Figure 5:
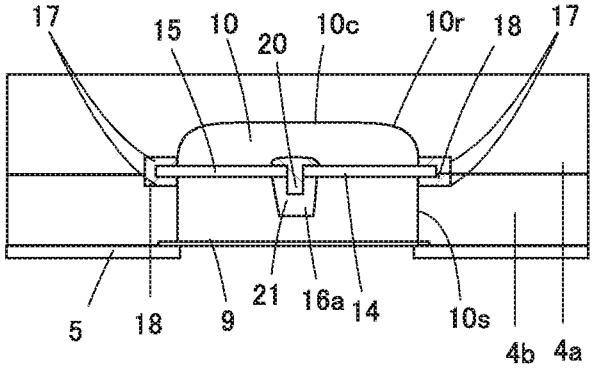
FIG. 5 is a sectional view taken in line V-V in FIG. 3.

FIG. 3 is a perspective view of the sports shoe according to the present embodiment, taken from a shoe sole side. FIG. 4 is a sectional view taken in line VI-VI in FIG. 3. FIG. 5 is a sectional view taken in line V-V in FIG. 3. As shown in FIG. 3, the sports shoe 1 according to the present embodiment includes the housing space 10 for housing a vibration absorbing unit 14 in the heel region 8.

The housing space 10 is a hole which opens in a bottom surface of the heel region 8 of the sole 2, and is formed by hollowing the midsole 4. Specifically, a through-hole is made in the heel region 8 of the lower midsole 4*b*, a bottomed-hole is made in the upper midsole 4*a*, and then the two midsoles are laminated to each other to obtain the housing space 10 of predetermined dimensions.

As shown in FIG. 3, the housing space 10 has a generally ellipse opening. Also, as shown in sectional views in FIG. 4 and FIG. 5, a corner portion 10*r* made by a ceiling surface 10*c* and a side surface 10*s* of the housing space 10 are rounded. By rounding the corner portion 10*r* between the ceiling surface 10*c* and the side surface 10*s* of the housing space 10, it becomes possible to decrease stress concentration on the corner portion 10*r* at a time when pressure from the foot is applied onto the midsole 4, and thereby reduce likelihood that the midsole will be damaged at the corner portion 10*r*.

Inside the housing space 10, the vibration absorbing unit 14 is housed. The vibration absorbing unit 14 includes a platy support portion 15 which is deflected by a landing impact; and a weight portion 16 (16*a*, 16*b*) provided in the support portion 15.

Preferably, the housing space 10 and the vibration absorbing unit 14 are sized in such a way that in an up-down direction, the space is greater than three times the amount of deflection of the vibration absorbing unit 14. Such an arrangement ensures, as will be described later, that even if the vibration absorbing unit 14 vibrates in the vertical direction, the weight portion 16 does not hit the upper or the lower wall of the housing space 10, and the vibration absorbing unit 14 is allowed to vibrate effectively. It should be noted here that the amount of deflection of the vibration absorbing unit 14 herein means a value obtained when the sports shoe is placed upside down and an amount of deflection of the support portion 15 caused by the weight of the weight portion 16 is divided by two.

Figure 7:
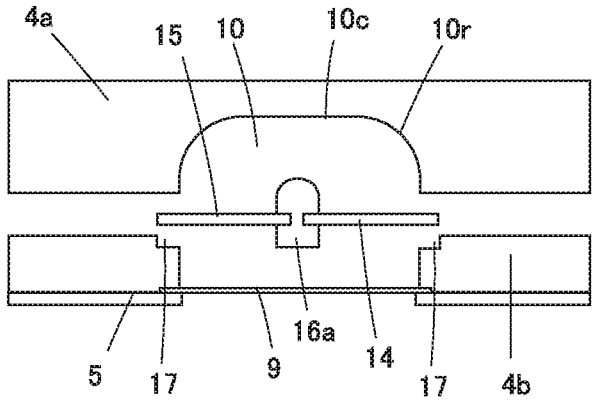
FIG. 7 is a sectional view which shows a variation of the attaching arrangement of the midsole and the vibration absorbing unit.
Figure 8:
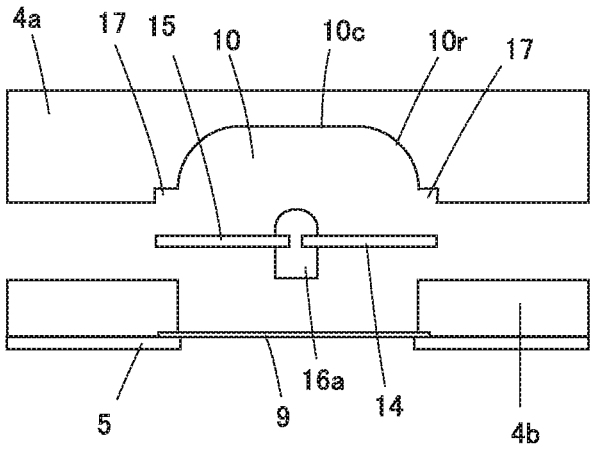
FIG. 8 is a sectional view which shows another variation of the attaching arrangement of the midsole and the vibration absorbing unit.

As shown in FIG. 4 and FIG. 5, the vibration absorbing unit 14 is supported as a perimeter region all around the support portion 15 is caught between the upper midsole 4*a* and the lower midsole 4*b* of the midsole 4. In the example in FIG. 5, the upper midsole 4*a* and the lower midsole 4*b* are formed with positioning recesses 17 respectively; the support portion 15 is fitted; and an adhesive 18 is used to fix the entire circumference of the support portion 15, thereby disposing the support portion 15 on the border of the upper midsole 4*a* and the lower midsole 4*b*. The positioning recesses 17 may be provided only in the lower midsole 4*b* as shown in FIG. 7, or only in the upper midsole 4*a* as shown in FIG. 8.

Figure 6:
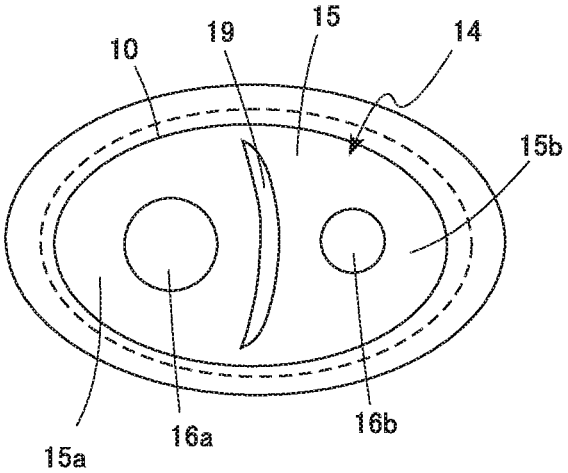
FIG. 6 is a schematic drawing which shows an attaching arrangement of a vibration absorbing unit which is attached to the sports shoe in FIG. 1.

FIG. 6 is a plan view of the vibration absorbing unit 14. As shown in FIG. 6, the support portion 15 has an outer shape line to fit to the positioning recesses 17 in the midsole 4. In the present embodiment, the support portion 15 is provided by a thin ellipse, flexible plate which is bended by a landing impact. The support portion 15 may be made of rubber, gel or resin for example.

The support portion 15 is designed, by selecting its shape or material property, to have a smaller bending rigidity (hereinafter, may simply referred to rigidity) in the vertical direction than in a horizontal direction. Upon impact, the support portion 15 deflects due to an inertia which works on the weight portion 16, and then vibrates due to the deflection. Also, since the support portion 15 has a smaller rigidity in the vertical direction, it makes a bigger vibration in the vertical direction.

Incases where the support portion 15 is fixed at its two ends, it is preferable that the perpendicular rigidity kp and the horizontal rigidity kh has a ratio (kh/kp) not smaller than 8, whereas if the support portion 15 is fixed at its one end, the ratio (kh/kp) is preferably not smaller than 40. Satisfying the above relationship makes the primary vibration mode in the horizontal direction greater than the secondary vibration mode in the vertical direction; i.e., the primary vibration mode in the horizontal direction does not disturb the primary vibration mode in the vertical direction which exhibits a shock absorption effect.

Specifically, when vibration due to a beam bending is considered, a natural frequency fn is expressed by the following Mathematical Expression (1).

[MATH 1]

$$f_n = \frac{\lambda_n^2}{2\pi}\sqrt{\frac{k}{m}} \tag{1}$$

where, n represents the degree of vibration mode whereas λ represents a constant which varies depending on a method of fixation and the degree.

For the primary vibration mode in the horizontal direction to be greater than the secondary vibration mode in the vertical direction, Mathematical Expression (2) is derived from Mathematical Expression (1):

[MATH 2]

$$\frac{k_h}{k_p} > \left(\frac{\lambda_2}{\lambda_1}\right)^4 \tag{2}$$

In Mathematical Expression (2), kh represents a rigidity in the horizontal direction whereas kp represents a rigidity in the vertical direction. Incases where the support portion 15 is fixed at its two ends, λ1 (primary) equals to 4.730, whereas λ2 (secondary) equals to 7.853 (see Handbook of Mechanical Engineering (Japan Society of Mechanical engineers)). Therefore, in order for the primary vibration mode in the horizontal direction to be greater than the secondary vibration mode in the vertical direction when the support portion 15 is fixed at its two ends, Mathematical Expression (2) suggests that the following inequality must be satisfied: (kh/kp)>7.6: Namely, it is preferable that the ratio between the rigidity in the vertical direction and the rigidity in the horizontal direction is not smaller than 8. In cases where the support portion 15 is fixed at one end, λ1 equals to 1.875 and λ2 equals to 4.694; therefore, (kh/kp)>39.3 from Mathematical Expression (2). Therefore, in cases where the support portion 15 is fixed at its one end, it is preferable that the ratio between the rigidity in the vertical direction and the rigidity in the horizontal direction is not smaller than 40.

It should be noted here that in the present embodiment, "two ends" of the support portion 15 means both ends of the support portion located on a long axis (the longest portion in the flat shape) of the vibration absorbing unit 14, whereas "one end" of the support portion 15 means one of the ends of the support portion located on the long axis of the vibration absorbing unit 14.

In an intermediate region of the support portion 15, there is a thin portion 19 as an example of the low rigidity region. As shown in FIG. 4 and FIG. 6, the thin portion 19 is provided by a groove formed in an intermediate position of the support portion 15, as easily bendable part. It should be noted here that the low rigidity region may be provided by a fold instead of a thin portion.

In two regions 15*a*, 15*b* which share the thin portion 19 of the support portion 15 as a boarder, the weight portions 16 (16*a*, 16*b*) are provided respectively. The weight portions 16 (16*a*, 16*b*) are provided by generally cylindrical weight each having a different weight from the other.

With the weight portions 16*a*, 16*b* which are different in their weight placed to sandwich the thin portion 19 in between, the vibration absorbing unit 14 is more likely to generate a plurality of different vibration patterns, making it possible to reduce vibration specific to an impact caused by each different pattern.

In the present embodiment, the rigidity kp [N/m] in the vertical direction of the support portion 15, and the mass m[kg] of the weight portions 16 are set in the following rages:

$$0.1 \leq kp \leq 2000$$

$$0.001 \leq m \leq 0.030$$

Setting the rigidity kh in the vertical direction of the support portion 15 and the mass m of the weight portion 16 in these ranges makes it possible to size the vibration absorbing unit 14 placeable within a housing space which is formable in a sole heel region of a sports shoe of a common size.

Herein, the rigidity kh in the vertical direction is defined as a value obtained by pressing the vibration absorbing unit at its center of gravity using a spring scale. Also, the mass m of the weight portion 16 is defined as a mass of the vibration absorbing unit not including fixed part of the support portion 15. The fixed part of the support portion 15 means a region of the support portion 15 which is in contact with the sole 2.

In the present embodiment, the weight portions 16*a*, 16*b* are provided as separate members from the support portion 15, and are attachable/detachable to and from predetermined positions of the support portion 15. In the example shown in FIG. 5, each of the weight portions 16*a*, 16*b* is made of two parts: a screw 20 and a receptacle 21. More specifically, the screw 20 having a male thread is positioned on the upper-surface side of the support portion 15; the receptacle 21 having a female thread is positioned on the upper-surface side of the support portion 15; and these two parts are threaded to each other with the support portion in between. The arrangement that the weight portion 16 is made of these mutually separable two or more parts makes it possible to replace one of the screw 20 and the receptacle 21 with one having a different weight. For example, when there is a desire to reduce vibration of a specific frequency, it is possible to change the weight portion 16 with another which has a more suitable weight and this increases freedom of design of the vibration absorbing unit 14. The weight portion 16 may be made in different ways using mutually separable two or more parts. For example, the weight portion 16 may have a fitting structure, composed of a projecting member which has a fitting protrusion, and a receptacle which has a corresponding recess to be fitted thereby.

As for the method for fixing the weight portion 16 to the support portion 15, the above embodiment shows an example of holding the support portion 15 between two members, but there are other methods, such as adhesive and thermal fusion. It is also possible that the support portion 15 and the weight portion are made integrally with each other using the same material. For example, part of the support portion may be made thicker so that that particular part will function as the weight portion.

Figure 9:
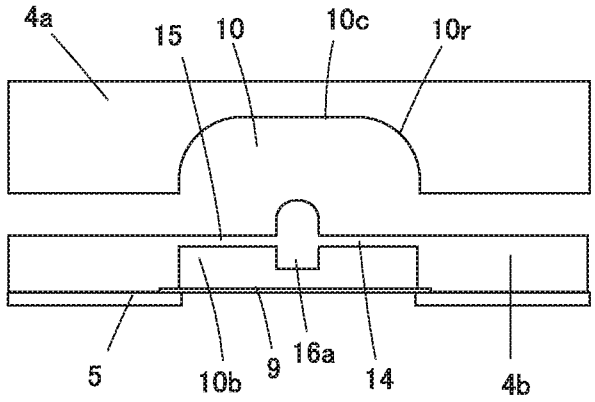
FIG. 9 is a sectional view which shows another variation in which the midsole, a support portion and a weight portion are made integral with each other.

It should be noted here that as shown in FIG. 9, it is also possible to make the support portion 15 and the weight portion 16 integrally with the midsole 4. FIG. 9 shows an example in which the support portion 15 is made integrally with the lower midsole 4*b*: The lower midsole 4*b* has a recessed hole 10*b* opening downward, and a ceiling surface thereof functions as a support portion 15. As another example, part of the support portion 15 may be made thicker so that that particular part will function as the weight portion. Such an arrangement makes it possible to manufacture the support portion and the weight portion integrally with the sole and thus to increase production efficiency.

In the present embodiment, a specific focus was made on loss tangent of a material for the support portion: In order to effectively reduce transmission of the vibration which will cause discomfort to the human body and to gradually decrease the vibration of the weight portion from the time of landing to the next time of landing, the support portion 15 is made of a resin. Specifically, a preferred value of the loss tangent tan δ is not smaller than 0.01.

In other words, by setting the loss tangent tan δ to a value not smaller than 0.01, much of the energy generated by landing is consumed by vibration of the weight portion 16. Then, by the time of the next landing, the weight portion 16 is ready to make large vibration to absorb much of energy generated by the impact.

In order to achieve efficient cushioning performance, it is necessary that the support portion 15 of the vibration absorbing unit 14 vibrates upon impact of the landing, and the vibration of the weight portion 16 is attenuated sufficiently by the time of next landing. By attenuating the vibration of the support portion 15 itself, it becomes possible to absorb a shock from the next landing without allowing vibration to disseminate, and to repeat the process.

A time constant τ[second] when a vibration amplitude of the weight portion 16 is attenuated by 63% (1/e) is expressed as $\tau=2/(\omega n \tan \delta)$, where ωn [rad/s] represents the primary natural frequency of the vertical direction of the support portion 15 whereas tan δ represents a loss tangent tan δ at 50 Hz, 25 degrees Celsius.

A time from landing to the next landing is approximately 0.6 seconds (an average of runners in general). This gives an inequation $\tau<0.6$, and when this relationship is satisfied, it is theoretically possible to repeatedly absorb the landing impact without disseminating vibration.

According to Non-Patent Literature 1, a resonant frequency of the chest at which people feel discomfort is 50-100 Hz. Hence, under the condition that these frequencies areabsorbed, the above relationship is satisfied when the tan δ is greater than 0.01. Therefore, a material having a smaller tan δ is not suitable. In the present embodiment, a resin material, for example, which has a having a tan δ greater than 0.01 is utilized for the support portion 16.

It should be noted here that the loss tangent tan δ in the present embodiment is a value obtained from a measurement by using a dynamic viscoelasticity rheometer (Rheogel-E4000 manufactured by UBM Co., Ltd.), when a specimen with 0% strain was given a ±0.025% strain in a pulling or compressing direction.

Figure 10:
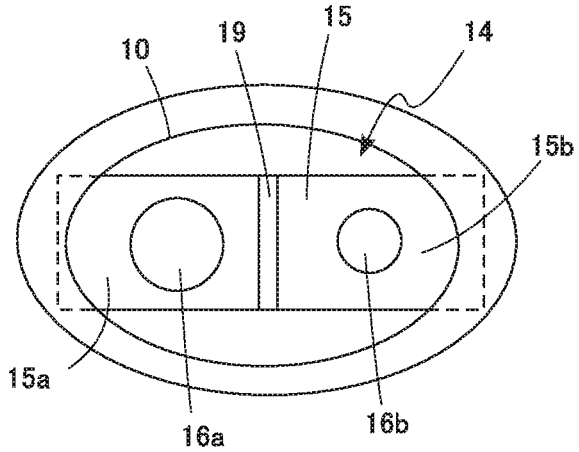
FIG. 10 is a schematic drawing which shows a variation of the vibration absorbing unit for attachment to the sports shoe in FIG. 1.

It should be noted here that the vibration absorbing unit 14 may be as shown in FIG. 10 for example; the support portion 15 has a belt-like shape, and two ends of the support portion 15 are fixed with the weight portions 16 in between.

Figure 11:
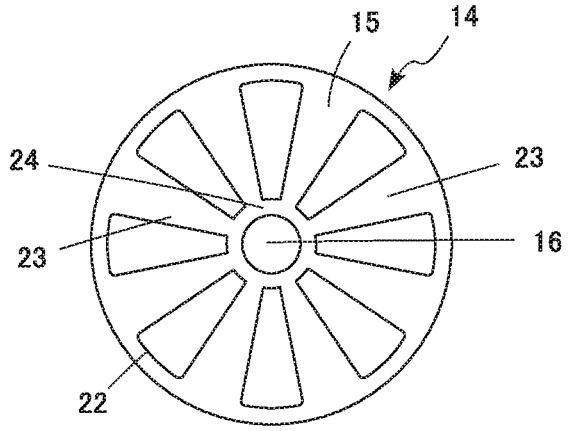
FIG. 11 is a schematic drawing which shows another variation of the vibration absorbing unit for attachment to the sports shoe in FIG. 1.

Also, the vibration absorbing unit 14 may be as shown in FIG. 11 for example; i.e., it is not necessary that the support portion 15 is provided by a thin platy member. In the variation example in FIG. 11, the support portion 15 includes an outer circumferential edge 22 which is placed to a perimeter edge of the opening of the housing space 10 in the sole; a weight attaching region 24 for attaching the weight portion 16; and a plurality of supporting arms 23 extending radially to the weight attaching region 24. The weight portion 16 is attached to the weight attaching region 24.

In this arrangement, the weight portion 16 is supported at its circumference intermittently, which decreases the support portion's rigidity in the vertical direction and increases likelihood of vibration generation in the vertical direction.

It should be noted here that the vibration absorbing unit 14 shown in FIG. 11 is made to support one weight portion 16 at its center. When the vibration absorbing unit 14 of this arrangement is utilized, the sole 4 may be formed with a plurality of the housing spaces 10, so that each is provided with the vibration absorbing unit 14 which has the weight portion having a different weight from the others.

Figure 12:
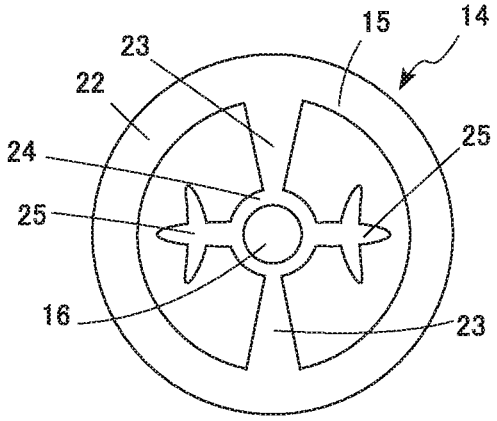
FIG. 12 is a schematic drawing which shows still another variation of the vibration absorbing unit for attachment to the sports shoe in FIG. 1.

The variation shown in FIG. 12 includes a small weight portion 25 which is provided integrally with the centrally-positioned weight attaching region 24. The small weight portion 25 deforms in a twisting fashion as the support portion 15 vibrates in the vertical direction, thereby altering a frequency of the entire support portion 15, enabling vibration covering a wide frequency range.

According to the sports shoe offered by the first embodiment, the rigidity of the support portion 15 in the vertical direction is smaller than the rigidity in the horizontal direction, and therefore the weight portion 16 vibrates mainly in the vertical direction. This vibration efficiently converts energy which is generated by landing impact of the foot during running or walking activities into vibration energy of the weight portion, thereby removing the energy. Hence, it is possible to efficiently remove landing impact, and reduce vibration which is propagated to the user.

Second Embodiment

Figure 13:
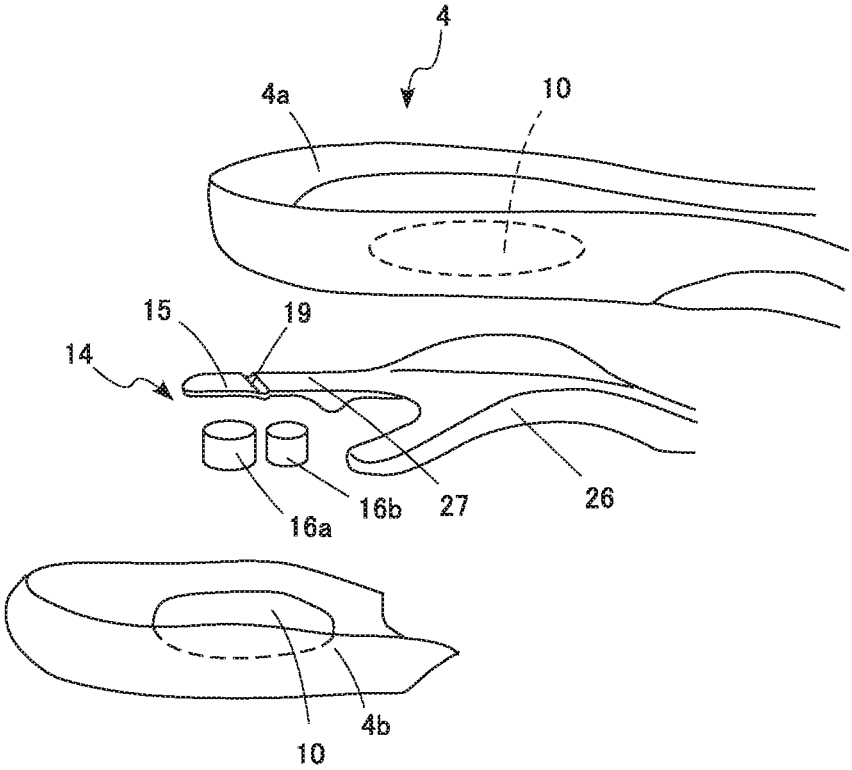
FIG. 13 is an exploded perspective view as a schematic drawing which shows an arrangement of a sole portion of a sports shoe according to a second embodiment.

FIG. 13 is an exploded perspective view as a schematic drawing which shows an arrangement of a sole portion of a sports shoe according to a second embodiment of the present invention. In the present embodiment, a sole 2 has a shank 26 disposed at the arch of the foot. The shank is a member used in a shoe sole to keep the shape of the arch of the foot, supports the arch region from below, and has a hardness to protect its arch shape from being collapsed by the user's weight. The shank may be made of a metal or a synthetic resin for example.

Behind the shank 26, a lower midsole 4*b* is provided only in a heel region 8. The lower midsole 4*b* is connected to an upper midsole 4*a* in lamination, and they form a midsole 4.

In the heel region 8 of the midsole 4, a housing space 10 is provided to house a vibration absorbing unit 14. The housing space 10 is a hole which opens in a bottom surface of the heel region 8 of the sole 2, and is shaped as a hollow in the midsole 4. Specifically, a through-hole is made in the heel region 8 of the lower midsole 4*b*, a bottomed-hole is made in the upper midsole 4*a*, and then the two midsoles are laminated to each other to obtain the housing space 10 of predetermined dimensions.

As shown in FIG. 13, a tongue piece 27 extends behind the shank 26, toward the heel. The tongue piece 27 functions as the support portion 15 of the vibration absorbing unit 14, and its region which is more rearward than its intermediate region is inside the housing space 10, whereas its end region protrudes beyond a rear region of the housing space 10. In this structure, the support portion 15 is fixed to the shank 26 at its one end.

In an intermediate region of the tongue piece 27, a thin portion 19 is provided as an example of the low rigidity region. With the thin portion 19 in between, weight portions 16 (16*a*, 16*b*) are provided. The weight portions 16 (16*a*, 16*b*) are provided by generally cylindrical weight each having a different weight from the other.

In the present embodiment, the weight portions 16*a*, 16*b* are provided as separate members from the support portion 15, and are adhesively bonded onto a lower surface side of the support portion 15.

In this arrangement, the portion of the tongue piece 27 located inside the housing space 10 functions as the support portion 15 of the vibration absorbing unit 14 and vibrates at a predetermined frequency upon landing impact. Since the support portion 15 is fixed only at its one end, the vibration absorbing unit has a smaller rigidity in the vertical direction than, for example, a support portion 15 which is made of the same material but is fixed at two ends, and vibrates more easily. Also, with the weight portions 16*a*, 16*b* which are different in their weight with the thin portion 19 in between, the vibration absorbing unit 14 is more likely to generate a plurality of different vibration patterns, making it possible to reduce vibration specific to an impact caused by each different pattern.

THIRD EMBODIMENT

Figure 14A:
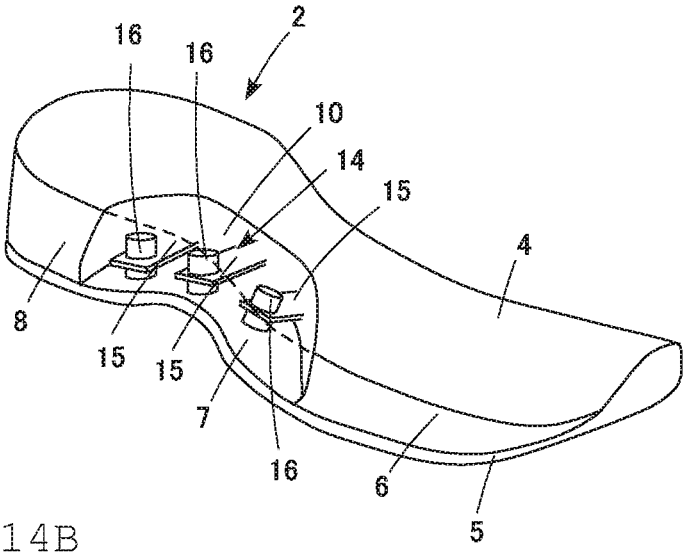
FIG. 14 includes two schematic drawings which show an arrangement of a sole portion of a sports shoe according to a third embodiment of the present invention.
Figure 14B:
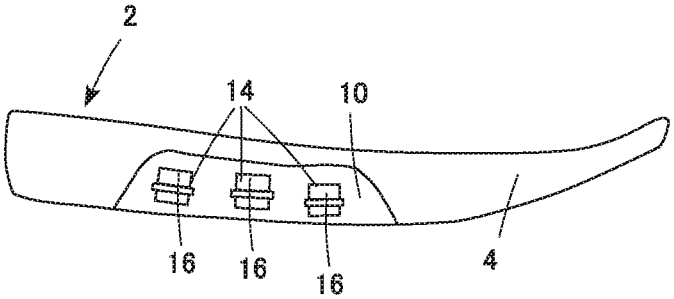
Figure 15:
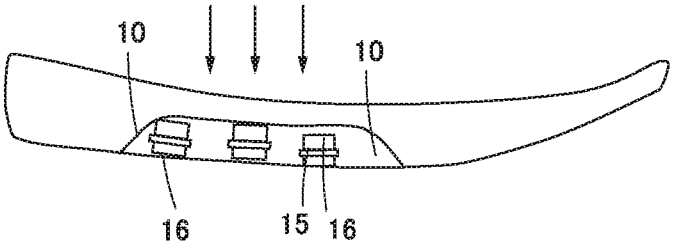
FIG. 15 is a side view which shows the sole portion in FIG. 14 under a load.

FIG. 14 includes two schematic drawings which show an arrangement of a sole portion of a sports shoe (for a left foot) according to a third embodiment of the present invention; FIG. 14(A) is a perspective view with a partial section, whereas FIG. 14(*b*) is a side view. FIG. 15 is a side view which shows the sole portion in FIG. 14 under a load. In the present embodiment, a sole 2 has its midfoot region 7 as a place where a housing space 10 is provided to house a vibration absorbing unit 14. Also, a vibration absorbing unit 14 includes three support portions 15 which vibrate at different frequencies from each other. Also, a support portions 15 are supported at their ends in the width direction of the sole 2.

The housing space 10 provided in the sole 2 is positioned at the midfoot region 7 which includes the arch of the foot as above-mentioned. As will be described later, the dimension of the height of the housing space 10 may be selected accordingly with the dimension of the height of the weight portions 16 which supports the midfoot region 7 from below.

The vibration absorbing unit 14 is arranged, in such a way that the three independent support portions 15 each supported at its ends in the width direction as described above are placed generally in parallel with each other in the fore-aft direction. Also, the weight portions 16 are positioned at the arch-of-the-foot region, i.e., more closely to one of the two ends. Each weight portion 16 has a different mass from the others, so that the support portions 15 vibrate at different frequencies.

In the sports shoe according to the present embodiment, the support portions 15 vibrate in different patterns from each other upon landing impact of the heel, and it is possible to remove vibration which propagates to the human body. Also, since the housing space 10 which houses the vibration absorbing unit 14 is placed at the midfoot region 7 which includes the arch of the foot, a load upon landing is exerted onto the midfoot region 7 from above to deform the housing space 10. In this process, as shown in FIG. 15, the weight portions 16 which are positioned at the arch region support the midfoot region 7 from below, making it possible to prevent an arch-shaped portion of the arch from overly deformation.

Figure 16:
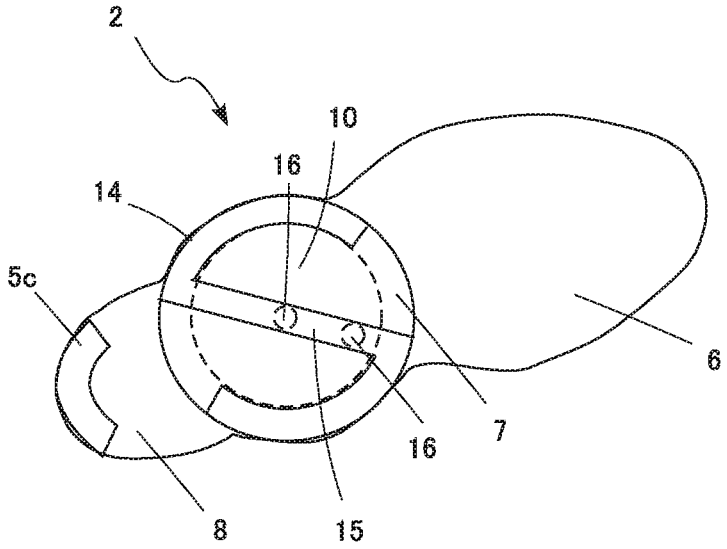
FIG. 16 is a schematic drawing of a variation of the sports shoe in FIG. 14, which shows a position where a vibration absorbing unit is disposed when viewed from a sole of the shoe.

As shown in a variation in FIG. 16, a sports shoe according to the present embodiment may have a midfoot region 7 which is wider than the heel region 8 so as to house a large vibration absorbing unit 14 inside the midfoot region 7. Also, the heel region 8 is provided with a cushioning member 5*c* to absorb landing impact.

In the variation shown in FIG. 16, the vibration absorbing unit 14 is made long by obliquely disposing the support portion 15. Also, the support portion 15 has its two ends rounded along the shape of midfoot region 7, thereby disposed inside the sole, in the midfoot region 7.

FOURTH EMBODIMENT

Figure 17:
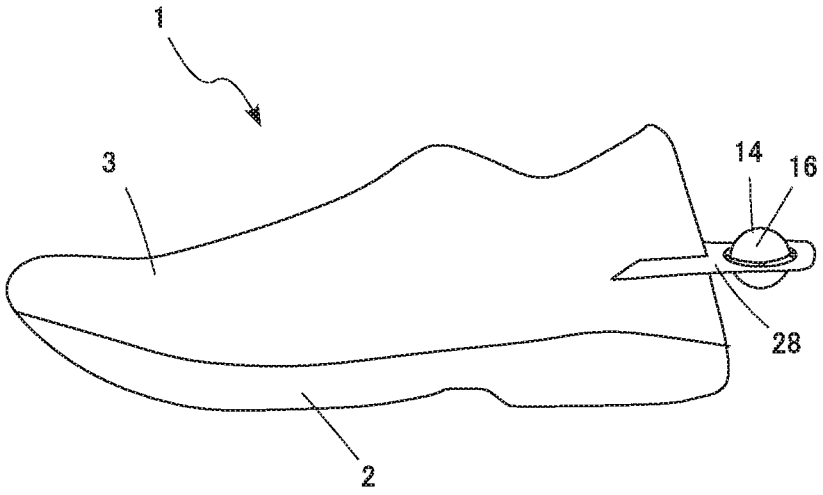
FIG. 17 is a side view as a schematic drawing which shows an arrangement of a sports shoe according to a fourth embodiment of the present invention.

FIG. 17 is a schematic drawing which shows an arrangement of a sports shoe according to a fourth embodiment of the present invention. The sports shoe 1 according to the present embodiment differs from the above-described embodiment in that the vibration absorbing unit 14 is not attached inside the sole 2, but attached on the upper. Specifically, the vibration absorbing unit 14 is attached at a position protruded rearward, via an attaching base 28 fixed to a heel region of the upper 3.

Figure 18:
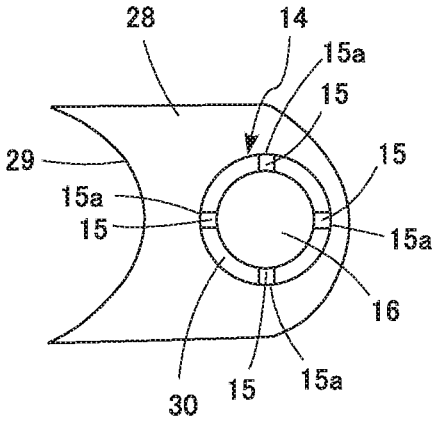
FIG. 18 is a schematic drawing, with partial enlargement, which shows an attaching arrangement of a vibration absorbing unit used in the sports shoe in FIG. 17.

FIG. 18 is a conceptual drawing, with partial enlargement, which shows an attaching arrangement of a vibration absorbing unit used in the fourth embodiment. A vibration absorbing unit 14 is fixed to the attaching base 28 which is fixed to the heel region of the upper 3 as part of the upper 3. The attaching base 28 is provided by a platy member, having its one side rounded in an arc-like curve along the shape of the heel region of the upper 3, serving as an attaching side 29. There is a through-hole, i.e., a holding hole 30 penetrating in the thickness direction. The vibration absorbing unit 14 is housed in the holding hole 30.

The holding hole 30 is a circular through-hole and has a larger opening than a weight portion 16, and an outer edge 15*a* which does not make contact with the weight portion 16 of a support portion 15. The support portion 15 in the present embodiment has four supporting arms. The weight portion 16 is spherical and is fixed to an inner end of each arm. Thus, the weight portion is disposed on an inner side of the holding hole 30 vibratably in the vertical direction. The number of supporting arms is not limited to four. Rather, whatsoever number is employable as far as the weight portion 16 can vibrate. Alternatively, the support portion 15 which is formed substantially the same shape as the holding hole 30 may be disposed to bury the holding hole 30 so that the support portion 15 is connected to the attaching base 28 along its entire outer edge. The energy generated by landing impact of the foot during running or walking activities is converted into vibration energy of the weight portion, and thus it is possible to remove vibration which propagates to the body. Also, since the vibration absorbing unit 14 is provided outside of the upper, there is less limitation on the attaching space as compared to cases where the attachment space is inside the sole 2. The arrangement makes it easy to make the weight portion 16 larger, and does not disturb the function of the sole 2. It should be noted here that the mass m of the weight portion 16 means a mass of the vibration absorbing unit not including fixed part of the support portion 15, and the fixed part of the support portion 15 means regions of the support portion 15 which is in contact with the attaching base 28.

Fifth Embodiment

Figure 19:
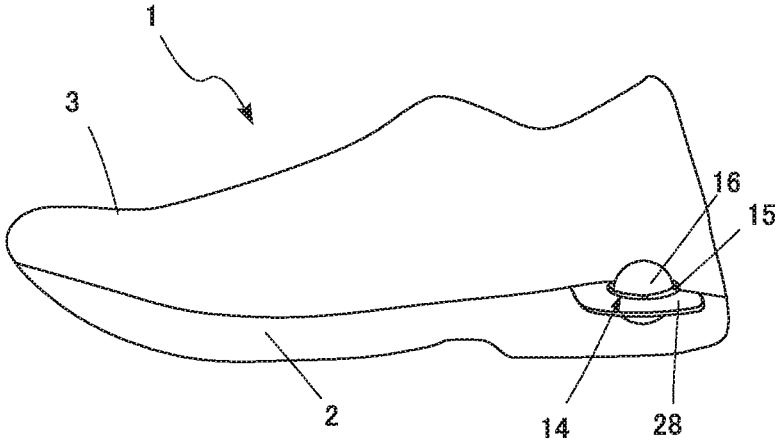
FIG. 19 is a side view as a schematic drawing which shows an arrangement of a sports shoe according to a fifth embodiment of the present invention.
Figure 20:
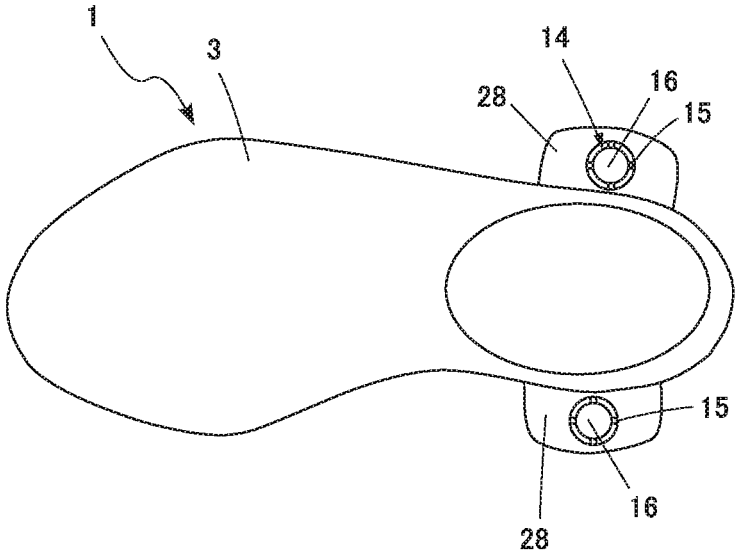
FIG. 20 is a plan view of the sports shoe in FIG. 19.

FIG. 19 is a schematic drawing which shows an arrangement of a sports shoe according to a fifth embodiment of the present invention in a side view. FIG. 20 is a schematic drawing which shows an arrangement of a sports shoe according to the fifth embodiment in a plan view. A sports shoe 1 according to the present embodiment is the same as the sports shoe according to the fourth embodiment in that a vibration absorbing unit 14 is not attached inside a sole 2, but is provided to protrude on an outside of an upper 3; however, an attaching base 28 to which a vibration absorbing unit 14 is attached is at a different place. The attaching base 28 is provided at a border region of the upper 3 and the sole 2, on two sides, to protrude laterally. Each houses a vibration absorbing unit 14 which is generally the same as in the fourth embodiment, inside a holding hole 30.

According to the present embodiment, since the vibration absorbing unit 14 is provided outside of the upper, the arrangement does not have limitations on the attaching space. The arrangement makes it easy to increase the weight portion 16, and does not disturb the function of the sole 2. Also, the center of gravity of the vibration absorbing unit and the center of load when the heel makes contact with the ground are not far from each other in the longitudinal direction of the foot. Therefore, easier vibration in the vertical direction and greater vibration absorption are expectable.

It should be noted here that the present invention is not limited to any of the embodiments described thus far, and may be varied in many ways. For example, the shape of the weight portion 16 is not limited to cylindrical or spherical. It may be prismatic, disc-like, or others.

Any embodiments in the various embodiments escribed thus far may be combined to implement advantages offered by each.

While the present invention has been fully described in connection with preferred embodiments with reference to the attached drawings, various changes and modification are obvious to those skilled in the art. Such variations and modifications should be understood to be included in the scope of the present invention defined in Claims attached herein, as far as those variations and modifications do not deviate therefrom.

REFERENCE SIGNS LIST

1 Sports Shoe
2 Sole
3 Upper
4 Midsole
4*a* Upper Midsole
4*b* Lower Midsole
5 Outer Sole
5*c* Cushioning Member
6 Forefoot Region
7 Midfoot region
8 Heel Region
9 Protection Plate
10 Housing Space
10*b* Recessed Hole
10*c* Ceiling Surface
10*r* Corner Portion
11 Top Cover
12 Inner Sole
13 Insole
14 Vibration Absorbing Unit

15 Support Portion
15*a* Support Portion's Outer Edge
16, 16*a*, 16*b* Weight Portions
17 Positioning Recess
18 Adhesive
19 Thin Portion
20 Screw
21 Receptacle
22 Outer Circumferential Edge
23 Supporting Arm
24 Weight Attaching Region
25 Small Weight Portion
26 Shank
27 Tongue Piece
28 Attaching Base
29 Attaching Side
30 Holding Hole

The invention claimed is:

1. A footwear comprising:
a sole;
an upper disposed on an upper side of the sole; and
a vibration absorbing unit fixed to the sole for absorption of a vibration generated by an impact caused by landing;
wherein
the vibration absorbing unit includes a platy flexible support portion which has a smaller rigidity in a vertical direction than in a horizontal direction, and a plurality of weight portions placed in the support portion; and
the support portion surrounds at least part of a perimeter of the weight portions, and is fixed to the sole;
the sole has a housing space in a heel region of the sole;
the vibration absorbing unit is disposed inside the housing space, and includes the plurality of weight portions having different weights;
the support portion has a center region provided by a low rigidity region which has a lower rigidity than regions of the support portion which surround the center region; and
the plurality of the weight portions are attached on two sides of the support portion with the low rigidity region in between.

2. A footwear comprising:
a sole;
an upper disposed on an upper side of the sole; and
a vibration absorbing unit fixed to at least one of the sole and the upper;
wherein
the vibration absorbing unit includes a platy support portion which is deflectable by a landing impact; and a plurality of weight portions which are attached to the support portion;
the support portion has a center region provided by a low rigidity region which has a lower rigidity than regions of the support portion which surround the center region, and the plurality of the weight portions are attached on two sides of the support portion with the low rigidity region in between; and
the support portion has a smaller rigidity in a vertical direction than in a horizontal direction, and is made of a material which has a loss tangent not smaller than 0.01 under a condition of 25 degrees Celsius and 50 Hz.

3. The footwear according to claim 2, wherein the sole has a housing space in a heel region, and the vibration absorbing unit is disposed inside the housing space.

4. The footwear according to any of claim 1 or 2, wherein the support portion has an entire outer perimeter fixed to the sole.

5. The footwear according to claim 3, wherein the housing space opens in a lower surface of the sole.

6. The footwear according to claim 5, wherein the opening of the housing space is closed by a protection plate.

7. The footwear according to claim 6, wherein the protection plate is translucent.

8. The footwear according to claim 3, wherein the support portion is supported by a side wall of the housing space along an entire perimeter of the housing space.

9. The footwear according to claim 3, wherein the plurality of the weight portions have different weights.

10. The footwear according to claim 9, wherein the low rigidity region is provided by a thin portion provided in the support portion.

11. The footwear according to any of claim 1 or 2, wherein the support portion and weight portions are made integrally with each other using a same material, with the weight portions being thicker than the support portion.

12. The footwear according to claim 3, wherein the sole includes an upper sole and a lower sole disposed under the upper sole; and the support portion is supported by being caught between the upper sole and the lower sole.

13. The footwear according to claim 3, wherein the sole includes an upper sole and a lower sole disposed under the upper sole; and the support portion is integral with the upper sole or the lower sole, being made of a same material.

14. The footwear according to claim 3, wherein the sole includes a shank disposed at a region of an arch of a foot; and the support portion is provided by a tongue piece extending from the shank toward the heel region.

15. The footwear according to any of claim 1 or 2, wherein the support portion has a rigidity in the vertical direction in a range from 0.1 through 2000 N/m, and the weight portion has a mass in a range 0.001 through 0.030 kg.

16. The footwear according to any of claim 1 or 2, wherein the support portion is fixed at two ends, a rigidity kp of the support portion in the vertical direction and a rigidity kh in the horizontal direction satisfies an inequation $(kh/kp)>8$.

17. The footwear according to any of claim 1 or 2, wherein the support portion is fixed at only one end, a rigidity kp of the support portion in the vertical direction and a rigidity kh in the horizontal direction satisfies an inequation $(kh/kp)>40$.

18. The footwear according to claim 3, wherein a corner portion between a ceiling surface and side surface of the housing space is rounded.

* * * * *